US011390475B2

(12) United States Patent
Waragai et al.

(10) Patent No.: US 11,390,475 B2
(45) Date of Patent: Jul. 19, 2022

(54) SHEET SEPARATION DEVICE AND IMAGE FORMING APPARATUS INCORPORATING SAME

(71) Applicants: Ryuhei Waragai, Kanagawa (JP); Naoki Oikawa, Kanagawa (JP); Kazuki Seto, Kanagawa (JP)

(72) Inventors: Ryuhei Waragai, Kanagawa (JP); Naoki Oikawa, Kanagawa (JP); Kazuki Seto, Kanagawa (JP)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 16/814,010

(22) Filed: Mar. 10, 2020

(65) Prior Publication Data

US 2020/0299081 A1 Sep. 24, 2020

(30) Foreign Application Priority Data

Mar. 20, 2019 (JP) ..... JP2019-052593

(51) Int. Cl.
*B65H 3/08* (2006.01)
*B65H 3/06* (2006.01)
*G03G 15/00* (2006.01)

(52) U.S. Cl.
CPC ..... *B65H 3/0692* (2013.01); *G03G 15/6511* (2013.01)

(58) Field of Classification Search
CPC ..... B65H 3/08; B65H 3/0816; B65H 3/0833; B65H 3/0866; B65H 3/48; B65H 3/124; B65H 3/128; B65H 3/12
See application file for complete search history.

(56) References Cited

U.S. PATENT DOCUMENTS 4,310,151 A * 1/1982 Fujimoto ..... B65H 3/08 271/103
4,589,647 A * 5/1986 Roller ..... B65H 3/128 271/34
4,596,385 A * 6/1986 Silverberg ..... B65H 3/48 271/108
4,887,805 A * 12/1989 Herbert ..... B65H 3/128 271/94
5,092,576 A * 3/1992 Takahashi ..... G03B 27/6257 271/146

(Continued)

FOREIGN PATENT DOCUMENTS

JP 2002-104679 4/2002

*Primary Examiner* — Thomas A Morrison
(74) *Attorney, Agent, or Firm* — Harness, Dickey & Pierce, P.L.C.

(57) ABSTRACT

A sheet separating device includes a receptacle, a pickup rotator, an air supplier, and a sheet floating restraint. The receptacle is configured to hold a plurality of sheets. The pickup rotator is configured to feed the plurality of sheets one by one from the receptacle. The air supplier includes an air outlet disposed ahead of the receptacle in a sheet feeding direction in which the plurality of sheets is fed. The air supplier is configured to blow air out from the air outlet toward a leading end of the plurality of sheets, held on the receptacle, in the sheet feeding direction. The sheet floating restraint is configured to restrain floating of a part of the plurality of sheets separated from each other by the air blown out from the air outlet.

12 Claims, 7 Drawing Sheets

(56) References Cited

U.S. PATENT DOCUMENTS

| | | | | |
|---|---|---|---|---|
| 5,344,133 | A * | 9/1994 | Jantsch | B65H 3/128 271/104 |
| 5,813,669 | A * | 9/1998 | Horii | B65H 3/10 271/105 |
| 5,921,540 | A * | 7/1999 | Acquaviva | B65H 3/128 271/104 |
| 7,490,826 | B2 * | 2/2009 | Takai | B65H 3/128 271/104 |
| 9,656,818 | B2 * | 5/2017 | Furuichi | B65H 3/48 |
| 2008/0088078 | A1 * | 4/2008 | Kushida | B65H 3/54 271/90 |
| 2008/0290589 | A1 * | 11/2008 | Uji | B65H 3/48 271/153 |
| 2010/0181716 | A1 * | 7/2010 | Suzuki | B65H 3/128 271/12 |
| 2013/0134651 | A1 * | 5/2013 | Kannari | B65H 7/20 271/105 |
| 2014/0339761 | A1 | 11/2014 | Oikawa et al. | |
| 2015/0239692 | A1 * | 8/2015 | Furuichi | B65H 3/48 271/11 |
| 2016/0214809 | A1 | 7/2016 | Waragai et al. | |

* cited by examiner

SHEET SEPARATION DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2019-052593, filed on Mar. 20, 2019, in the Japan Patent Office, the entire disclosure of which is hereby incorporated by reference herein.

BACKGROUND

Technical Field

Embodiments of the present disclosure relate to a sheet separating device and an image forming apparatus incorporating the sheet separating device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such image forming apparatuses often include a sheet separating device for feeding a plurality of sheets, as recording media, one by one from a receptacle. The sheet separating device typically includes the receptacle on which the plurality of sheets is stackable and a pickup rotator that feeds the plurality of sheets from the receptacle.

SUMMARY

In one embodiment of the present disclosure, a novel sheet separating device includes a receptacle, a pickup rotator, an air supplier, and a sheet floating restraint. The receptacle is configured to hold a plurality of sheets. The pickup rotator is configured to feed the plurality of sheets one by one from the receptacle. The air supplier includes an air outlet disposed ahead of the receptacle in a sheet feeding direction in which the plurality of sheets is fed. The air supplier is configured to blow air out from the air outlet toward a leading end of the plurality of sheets, held on the receptacle, in the sheet feeding direction. The sheet floating restraint is configured to restrain floating of a part of the plurality of sheets separated from each other by the air blown out from the air outlet.

Also described is a novel image forming apparatus incorporating the sheet separating device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
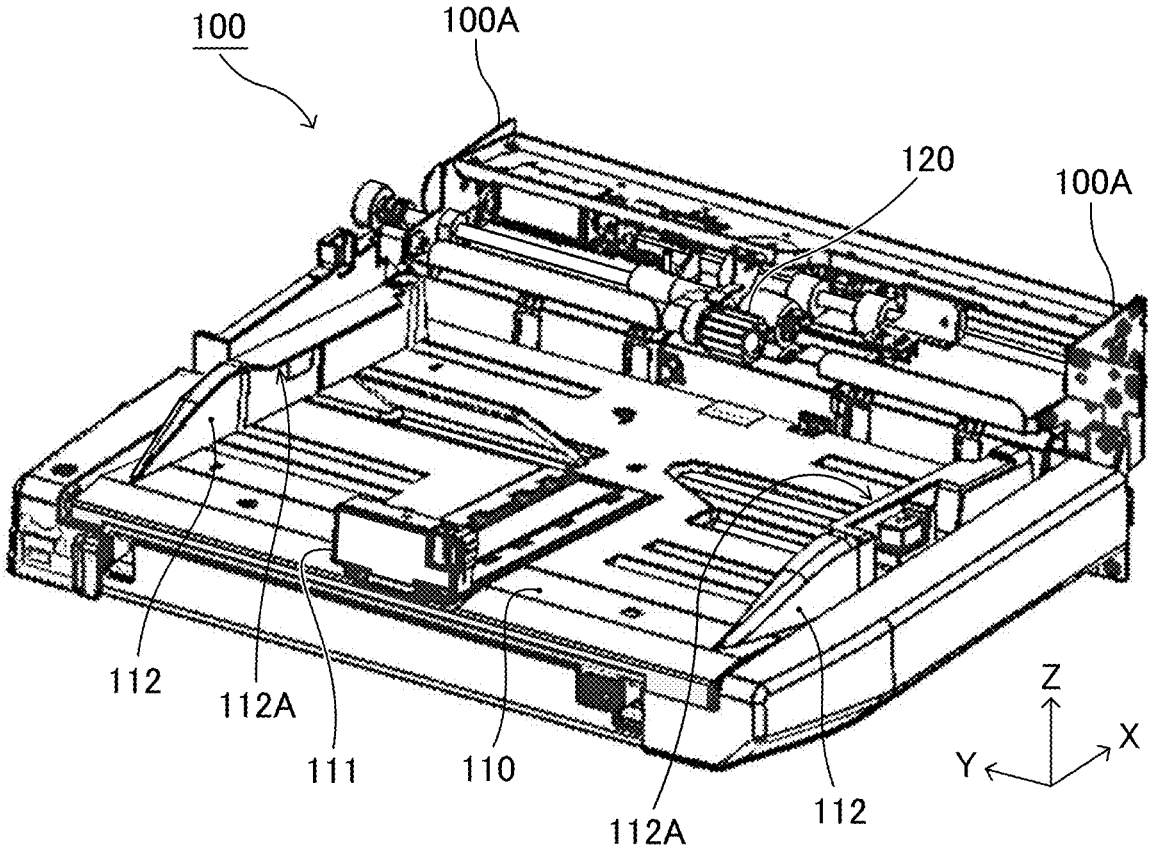
FIG. 1 is a perspective view of a sheet separating device according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a," "an," and "the" are intended to include the plural forms as well, unless the context clearly indicates otherwise.

Referring to the drawings, wherein like reference numerals designate identical or corresponding parts throughout the several views, embodiments of the present disclosure are described below.

Specifically, a description is now given of a sheet separating device (or a sheet feeding device) according to an embodiment of the present disclosure, suitable for handling a recording medium used as a sheet material particularly in an image forming apparatus. The recording medium is herein after referred to as a recording sheet or simply as a sheet.

FIG. 1 is a perspective view of a sheet separating device 100 according to an embodiment of the present disclosure.

The sheet separating device 100 includes a tray 110 and a pickup roller 120. The tray 110 is a receptacle that holds a plurality of sheets S serving as recording media. In other words, a plurality of sheets S is stackable on the tray 110. The pickup roller 120 is a pickup rotator that feeds the plurality of sheets S one by one. The sheet separating device 100 feeds the plurality of sheets S from the tray 110 one by one.

Figure 3:
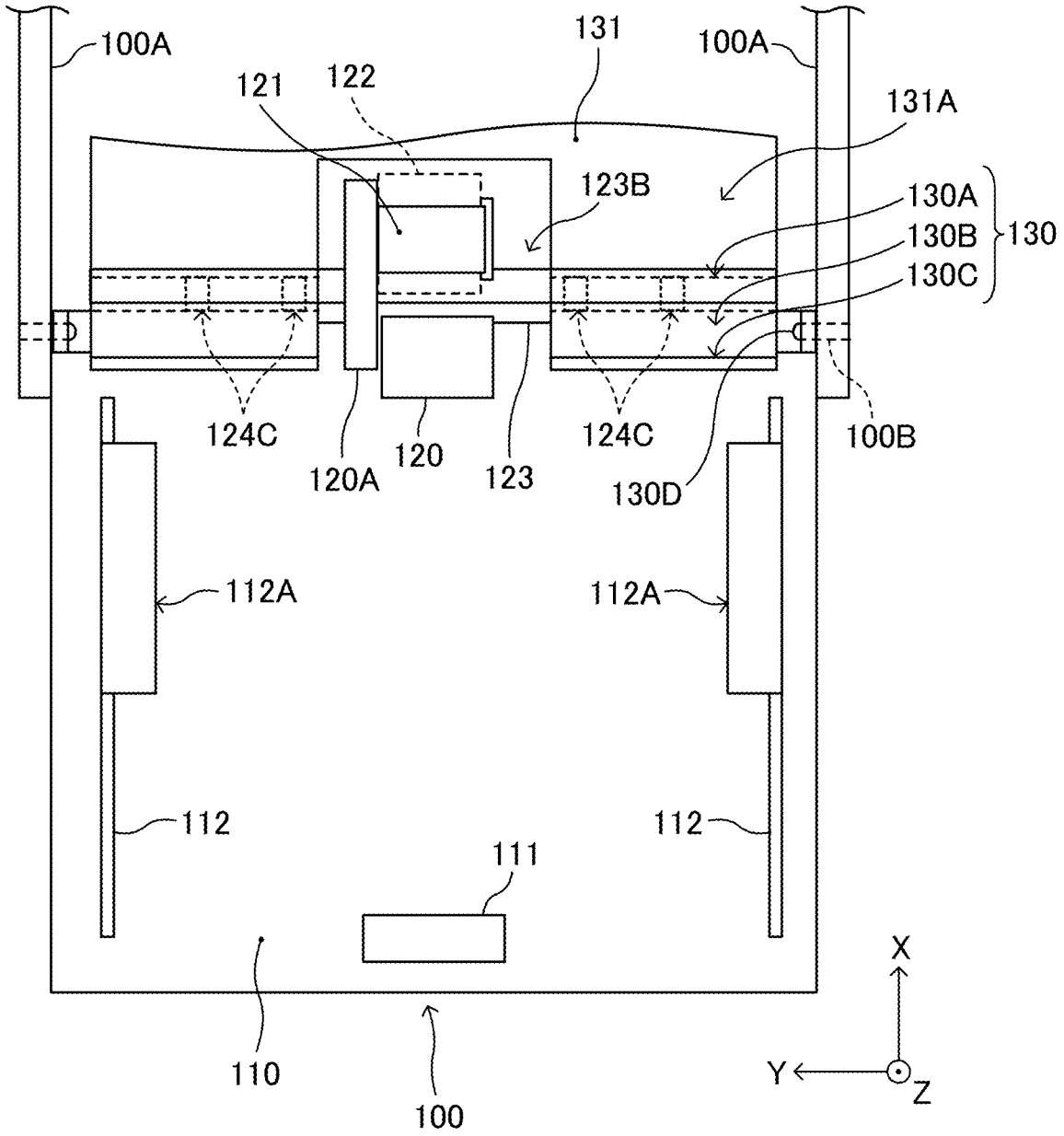
FIG. 3 is a plan view of the sheet separating device of FIG. 1.

An end fence 111 and a side fence pair 112 are disposed on the tray 110. The end fence 111 regulates a trailing end of the sheet S in a direction in which the sheet S is fed or conveyed. Note that the direction in which the sheet S is fed or conveyed is hereinafter referred to as a sheet feeding direction or a sheet conveying direction. The side fence pair 112 regulates opposed widthwise ends of the sheet S. Note that a width direction of the sheet S corresponds to a direction perpendicular to the sheet feeding direction. The side fence pair 112 is provided with a side sheet floating restraint pair 112A. Specifically, the side sheet floating restraint pair 112A is disposed on opposed widthwise end portions of the sheet separating device 100 perpendicular to the sheet feeding direction to restrain floating of a part of the plurality of sheets S separated from each other. The side sheet floating restraint pair 112A is disposed between the end fence 111 and a front sheet floating restraint 130 as illustrated in FIG. 3. Each of the side sheet floating restraint pair 112A extends from an upper portion of each of the side fence pair 112 toward a widthwise center of the sheet separating device 100 by a given length.

In the present embodiment, the side fence pair 112 is thus provided with the side sheet floating restraint pair 112A. Alternatively, however, either one of the side fence pair 112 is provided with a side sheet floating restraint 112A. In a case in which a single side sheet floating restraint 112A is disposed on either one of the side fence pair 112, the side sheet floating restraint 112A preferably has a length equal to or greater than one tenth of a length between the side fence pair 112.

Figure 2:
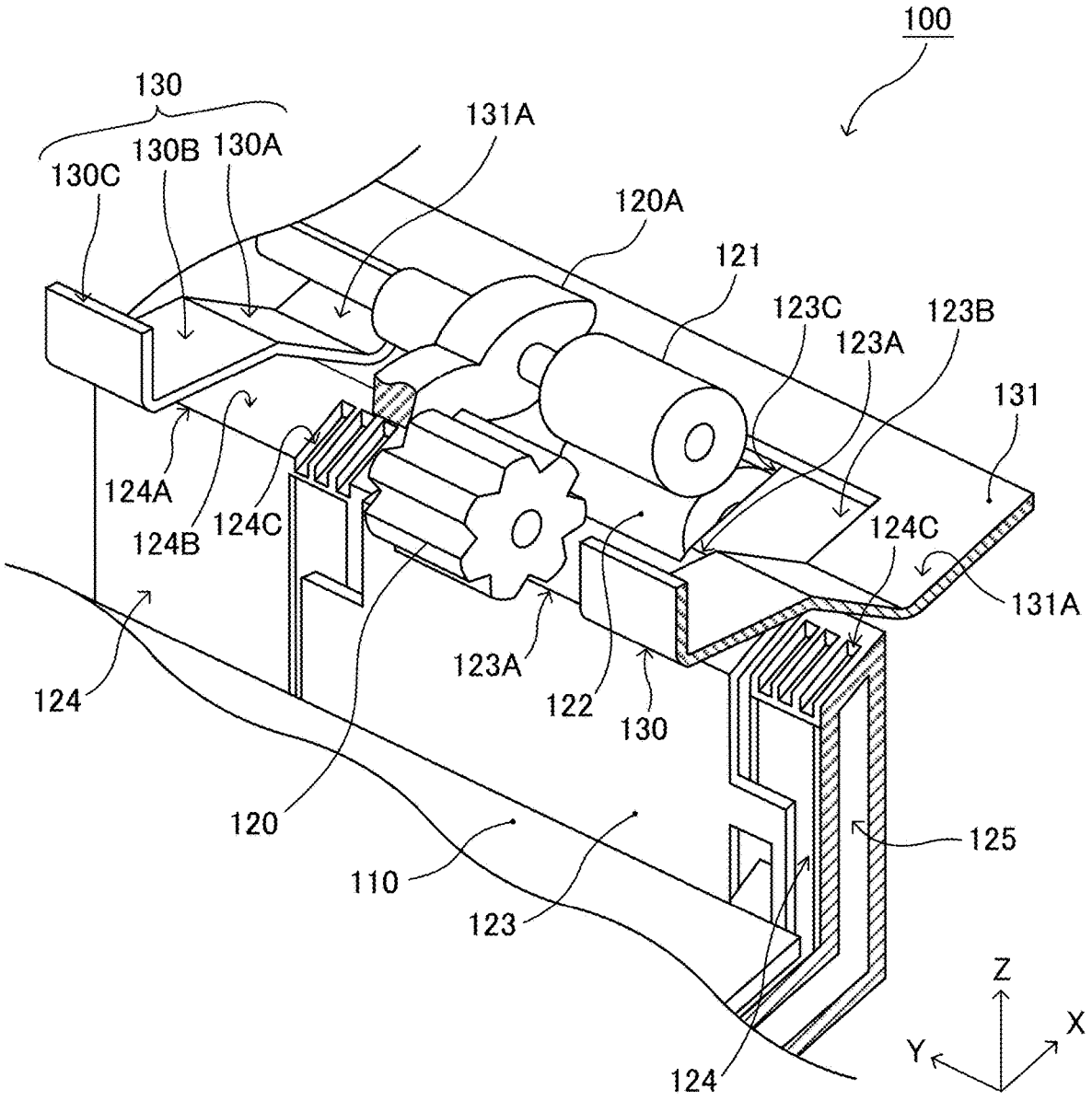
FIG. 2 is an enlarged perspective view of a pickup roller and surrounding components in the sheet separating device of FIG. 1.

FIG. 2 is an enlarged perspective view of the pickup roller 120 and surrounding components in the sheet separating device 100.

The pickup roller 120, a feed roller 121, and a reverse roller 122 construct a separating and feeding unit employing a so-called feed and reverse roller (FRR) sheet feeding method. The feed roller 121 conveys further a sheet S reaching the feed roller 121. The reverse roller 122 contacts the feed roller 121 from below. A driver drives and rotates the reverse roller 122 via a torque limiter in a direction to return the sheet S toward the pickup roller 120. The pickup roller 120 is supported by a swing arm 120A.

A front wall plate 123 is a part of a front wall against which a leading end of the sheet S in the sheet feeding direction on the tray 110 abuts. The front wall plate 123 is disposed opposite the pickup roller 120 and the like in the width direction of the sheet separating device 100. The front wall plate 123 is bent at two bent portions 123A from a vertically extending portion and extends downstream in the sheet feeding direction. The front wall plate 123 includes a lower guide plate 123B as a portion thus extending downstream in the sheet feeding direction. An upper portion of the reverse roller 122 projects from an opening 123C formed in the lower guide plate 123B. A portion between the two bent portions 123A is inclined so as to become higher downstream in the sheet feeding direction.

On each widthwise side of the front wall plate 123 is a front wall face 124 extending vertically like the front wall plate 123. An upper portion of the front wall face 124 includes a bent portion 124A. An inclined upper face 124B is a portion of the front wall face 124 above the bent portion 124A. The inclined upper face 124B has an inclination identical to an inclination of the portion between the two bent portions 123A in an upper portion of the front wall plate 123. An air outlet 124C is opened on the inclined upper face 124B. Air from an air duct 125 is blown out through the air outlet 124C. The front sheet floating restraint 130 is disposed on each outer side of the pickup roller 120 in the width direction of the sheet separating device 100. The front sheet floating restraint 130 includes a first inclined portion 130A, a second inclined portion 130B, and a rising portion 130C in this order from a downstream side in the sheet feeding direction. The front sheet floating restraint 130 extends from an upper guide plate 131 upstream in the sheet feeding direction. Specifically, the front sheet floating restraint 130 continues to each of upper guide plate parts 131A of the upper guide plate 131. The upper guide plate parts 131A deviate from and are located respectively on both sides of a portion of the upper guide plate 131 opposite the rollers such as the pickup roller 120 in a width direction of the rollers. That is, the front sheet floating restraint 130 extends from the upper guide plate part 131A upstream in the sheet feeding direction.

FIG. 3 is a plan view of the sheet separating device 100.

The front sheet floating restraint 130 extends, on each outer sides of the pickup roller 120 in the width direction of the sheet separating device 100, toward a vicinity of an inner wall surface of the corresponding one of a housing side plate pair 100A of the sheet separating device 100. The pickup roller 120 is interposed between the two pairs of air outlets 124C in the width direction of the sheet separating device 100. In other words, the four air outlets 124C are disposed as illustrated in FIG. 3. The front sheet floating restraints 130 are located above the air outlets 124C.

Each of the front sheet floating restraints 130 has an outer end portion in the width direction of the sheet separating device 100 secured to the corresponding one of the housing side plate pair 100A. For example, a screw 130D is driven through a vertically long slot 100B of each of the housing side plate pair 100A to secure the front sheet floating restraint 130 to each of the housing side plate pair 100A. By changing the position of fastening the screw 130D in a longitudinal direction in the long slot 100B, an inclination angle of the front sheet floating restraint 130 is adjustable. In other words, the front sheet floating restraint 130 is inclined at a changeable angle. In a case in which the front sheet floating restraint 130 is formed as a part of the upper guide plate 131, the posture of the upper guide plate 131 changes as the inclination angle of the front sheet floating restraint 130 changes. To prevent such a situation, the connecting portion between the front sheet floating restraint 130 and the upper guide plate 131 may be configured such that the angle between the front sheet floating restraint 130 and the upper guide plate 131 is changeable. Alternatively, the front sheet floating restraint 130 and the upper guide plate 131 may be secured as components dependent from each other.

Figure 4:
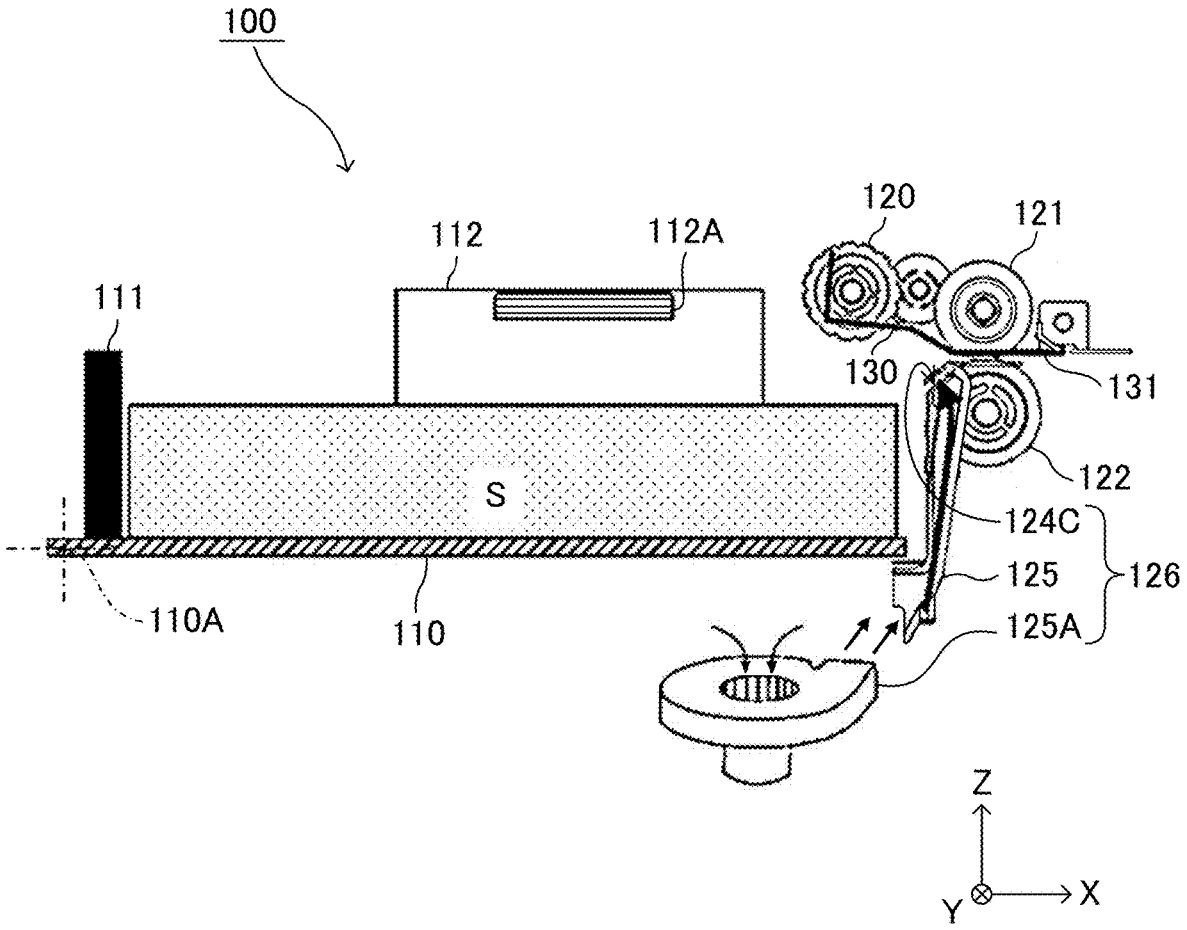
FIG. 4 is a schematic view of the sheet separating device of FIG. 1.

FIG. 4 is a schematic view of main components of the sheet separating device 100 for separating and feeding a sheet S.

As the tray 110 rotates around a rotation fulcrum 110A or horizontally rises, a sheet S or an uppermost sheet S of a plurality of sheets S comes into contact with the pickup roller 120 and enters a feedable state. A fan 125A, serving as an air supply, supplies air to the air duct 125, which is an air chamber. The air duct 125 is disposed to blow the air above the plurality of sheets S stacked, through the air outlets 124C above the air duct 125. The fan 125A, the air duct 125, the air outlets 124C, and the like construct an air supplier 126. Specifically, the air outlets 124C are disposed ahead of the tray 110 in the sheet feeding direction in which the plurality of sheets S is fed. The air supplier 126 blows air out from the air outlets 124C toward a leading end of the plurality of sheets S in the sheet feeding direction. The air from the air outlets 124C may lift a part of the plurality of sheets S. In order to prevent the part of the plurality of sheets S from being blown off, the present embodiment provides the front sheet floating restraint 130, in addition to the side sheet floating restraint pair 112A, to restrict floating of the plurality of sheets S. Specifically, the front sheet floating restraint 130 restraints floating of the part of the plurality of sheets S separated from each other by the air blown out from the air outlets 124C.

Figure 5:
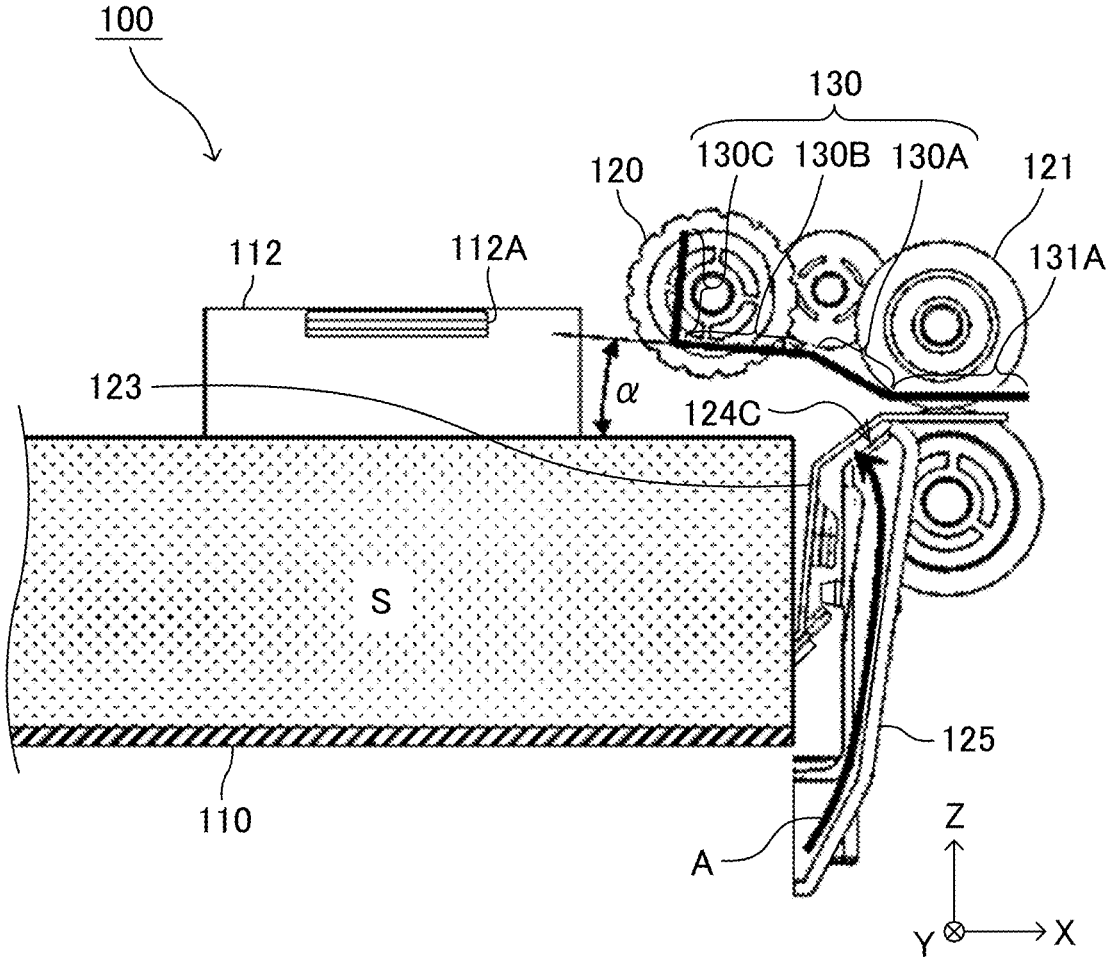
FIG. 5 is a partial enlarged view of the sheet separating device of FIG. 1.

FIG. 5 is an enlarged view of the vicinity of the front sheet floating restraint 130 of FIG. 4.

The side sheet floating restraint pair 112A and the front sheet floating restraint 130 restrict a floating sheet S from being blown off. The side sheet floating restraint pair 112A and the front sheet floating restraint 130 are different from each other in whether the side sheet floating restraint pair 112A and the front sheet floating restraint 130 are parallel to a surface of a sheet S or have an angle α with respect to the surface of the sheet S. Specifically, the side sheet floating restraint pair 112A is parallel to the sheet S; whereas the front sheet floating restraint 130 forms the angle α with respect to an upper surface of the sheet S resting on the tray 110, but not lifted by air. More specifically, a lower surface of the second inclined portion 130B forms the angle α. The second inclined portion 130B contacts an upper surface of a floating sheet S and restricts further floating of the sheet S. As illustrated in FIG. 5, the front sheet floating restraint 130 is inclined at the angle α with respect to the upper surface of the sheets S such that a distance between the front sheet floating restraint 130 and the upper surface of the sheets S increases downstream from an air outlet 124C side in an air blowing direction A. In other words, the angle α of the front sheet floating restraint 130 inclines the front sheet floating restraint 130 in a direction in which the distance between the front sheet floating restraint 130 and the upper surface of the sheets S increases from the air outlet 124C side. Preferably, the angle α is an acute angle.

Figure 6:
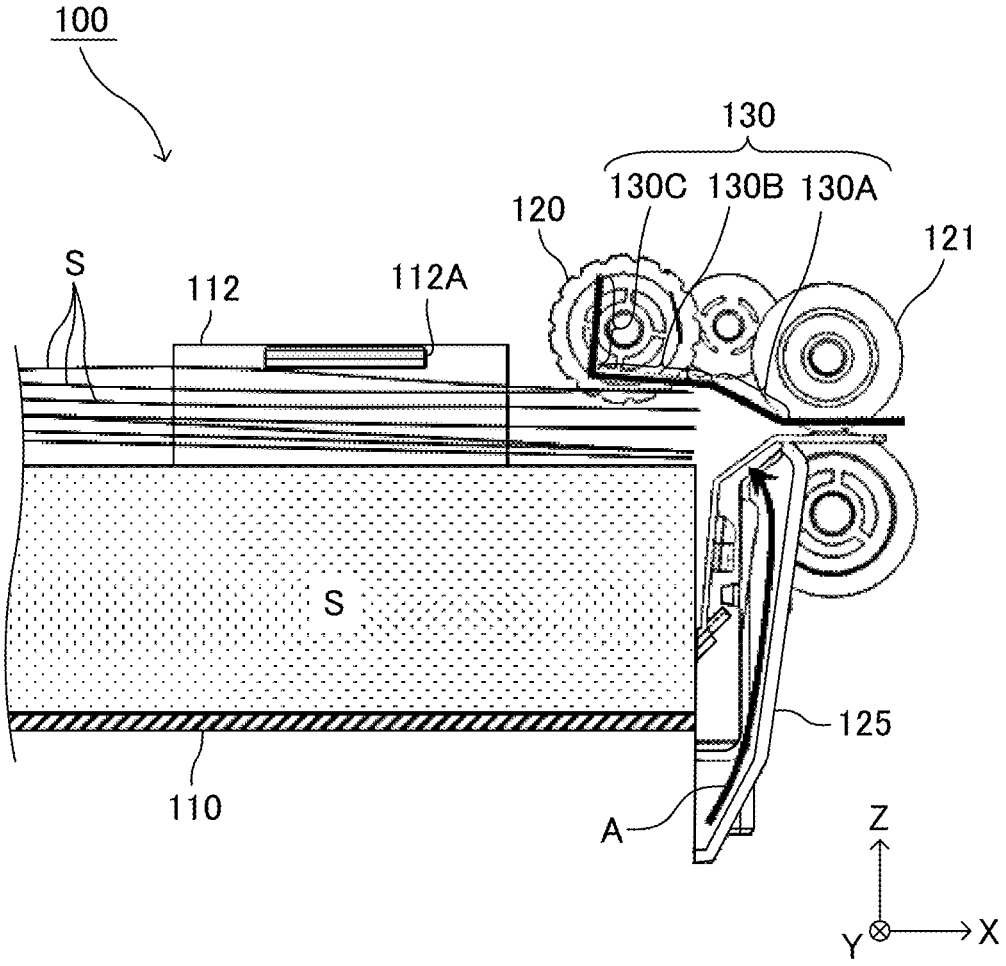
FIG. 6 is another partial enlarged view of the sheet separating device of FIG. 1, in a state in which air is blown.

FIG. 6 is another enlarged view of the vicinity of the front sheet floating restraint 130, in a state in which air is blown.

As described above, the front sheet floating restraint 130 restrains floating of sheets S. In addition, the front sheet floating restraint 130 receives air blown out from the air outlets 124C and changes the air blowing direction A. Specifically, the front sheet floating restraint 130 sends the air substantially parallel to the sheets S. In other words, the front sheet floating restraint 130 corrects the air blowing direction A to a direction in which the sheets S are reliably separated from each other. That is, the air flow parallel to the sheets S effectively separates the sheets S from each other.

The angle α depends on a channel shape of the air duct 125, size and relative positions of the air outlets 124C, and the like. However, the angle α is desirably an acute angle. An obtuse angle is inefficacious in restraining floating of the sheets S and correcting the air blowing direction A out from the air outlets 124C.

In order to receive the air and change the air blowing direction A, the front sheet floating restraint 130 is made of a material capable of guiding air. Specifically, the material and the structure of the front sheet floating restraint 130 do not allow the air to pass through the front sheet floating restraint 130 in a thickness direction of the front sheet floating restraint 130. In a case in which the front sheet floating restraint 130 simply restrains floating of sheets S, rather than changes the air blowing direction A, such material and structure may not be adopted. In such a case, a sheet S restrained from floating may serve as an air guide that guides air entering between the sheet S and another sheet S below the sheet S. Even when the sheet S thus serves as an air guide, the inclination of the front sheet floating restraint 130 at the angle α is efficacious in regulating the posture of the sheets S. Therefore, in a case in which the sheet S sufficiently serves as an air guide or such an air guiding function is not expected in the first place, the material and the structure of the front sheet floating restraint 130 may allow the air to pass through the front sheet floating restraint 130 in the thickness direction of the front sheet floating restraint 130.

According to the embodiment described above, the air outlets 124C are disposed so as to blow the air out toward the leading end of the sheets S in the sheet feeding direction. Alternatively, the air outlets 124C may be disposed so as to blow the air toward the trailing end or a side of the sheets S in the sheet feeding direction. That is, in the sheet separating device 100 that includes the air outlets 124C near the tray 110 (more specifically, the sheets S held on the tray 110) to blow air toward an end surface of the sheets S, the front sheet floating restraint 130 inclined at the angle α with respect to the surface of the sheets S as in the sheet separating device 100 described above reliably restricts the floating of the sheets S. In the sheet separating device 100 that includes the air outlets 124C near the tray 110 (e.g., on a side of the sheets S) to blow air toward the end surface of the sheets S, the front sheet floating restraint 130 is inclined at the angle α with respect to the upper surface of the sheets S such that the distance between the front sheet floating restraint 130 and the upper surface of the sheets S increases downstream from the air outlet 124C side in the air blowing direction A. In other words, the angle α of the front sheet floating restraint 130 inclines the front sheet floating restraint 130 in the direction in which the distance between the front sheet floating restraint 130 and the upper surface of the sheets S increases from the air outlet 124C side. The angle α is desirably an acute angle.

Figure 7:
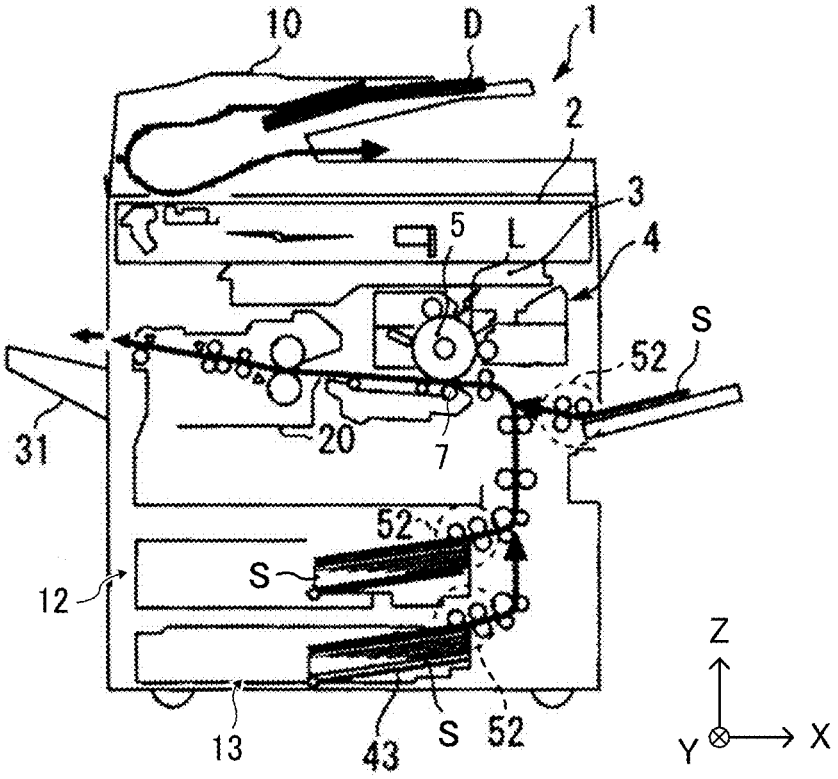
FIG. 7 is a schematic view of an image forming apparatus to which the sheet separating device of FIG. 1 is applied.

Referring now to FIG. 7, a description is given of an image forming apparatus 1 to which the sheet separating device 100 of the present embodiment is applied.

FIG. 7 is a schematic view of the image forming apparatus 1.

A document D, conveyed or fed by a document feeder 10 in a direction indicated by arrow in FIG. 7, passes over a document reader 2. The document reader 2 optically reads image data of the document D. An exposure device 3, serving as a writer, irradiates a drum-shaped photoconductor 5 of an image forming device 4 with exposure light L, such as a laser beam, according to the image data thus read. The image forming device 4 performs a given series of image forming processes, such as a charging process, an exposing process, and a developing process, to form a toner image corresponding to the image data on the photoconductor 5. A transfer device 7 transfers the toner image from the photoconductor 5 onto a sheet S conveyed from a selected one of a plurality of feeding devices 12 and 13. A fixing device 20 fixes the toner image onto the sheet S after the transfer process. The sheet S bearing the fixed toner image is discharged onto an output tray 31.

As illustrated in FIG. 7, the plurality of feeding devices 12 and 13 are disposed in a housing of the image forming apparatus 1. The plurality of feeding devices 12 and 13 has substantially the same configuration. For example, the feeding device 13 includes a receptacle 43 (e.g., elevation plate) and a feeding assembly 52. A plurality of sheets S lies stacked on the receptacle 43. The feeding assembly 52 serves as a feeder that feeds the plurality of sheets S one by one from the receptacle 43. The sheet separating device 100 of the present embodiment can be used as each of the plurality of feeding devices 12 and 13.

Note that a sheet feeding device incorporating an air blower, like the sheet separating device 100 according to the present embodiment, has the following advantages. Generally, a sheet feeding device incorporated in an image forming apparatus includes a sheet loader such as a bottom plate. The sheet feeding device separates and feeds sheets serving as recording media stacked on the bottom plate one by one toward an image forming device. Examples of such sheets include coated paper and art paper. The sheets of coated paper or art paper have hygroscopicity, good surface smoothness, and low air permeability. Therefore, in a high humidity environment, the adhesion between the sheets tends to increase. That is, the sheets of coated paper or art paper have difficulties in separation, compared to the sheets of plain paper, resulting in frequent multiple feeding or continuous feeding.

To reduce the adhesion between the sheets, air is blown toward an end portion of the sheets. Specifically, air is blown to an end surface of the sheets under pressure that does not attract the sheets to each other, thereby separating the sheets from each other.

The sheet feeding device is also configured to restrain excessive floating of a part of the sheets separated from each other by air blown out from an air outlet. With this configuration, the floating sheets are not turned up or blown off. Since the air is blown in a direction perpendicular to the end surface of the sheets to efficiently separate the sheets, a sheet floating restraint is disposed in parallel with the sheets or the bottom plate to increase the separating efficiency and ensure the separation of the sheets.

However, typical sheet feeding devices have some difficulties in maximizing the sheet separating effectiveness unless the air is blown perpendicularly to the sheets, because the sheet floating restraint is disposed in parallel with the sheets or the bottom plate. To address such a situation, the angle $\alpha$ is formed in the sheet separating device 100 of the present embodiment.

The sheet separating device 100 of the present embodiment has some other advantages as below. A typical sheet floating restraint is generally disposed in parallel with a bottom plate or sheets to effectively restrain floating of the sheets. In addition, the air flow parallel to the sheets S effectively separates the sheets S from each other. The sheet floating restraint disposed in parallel with the sheets contacts a floating sheet, allowing the air to be blown at right angles to an end surface of the sheets.

Occasionally, however, an air blower may not be installed horizontally to the end portion of the sheets to blow air. The air blower disposed at a horizontal position to the end portion of the sheets may enlarges the overall configuration of a sheet feeding device, affecting downsizing of the sheet feeding device. To address such a situation, the air blower may be disposed below the end portion of the sheets (that is, in a direction of blowing up an upper part of the stacked sheets). However, the air blower thus disposed does not blow air horizontally to the end portion of the sheets, reducing the sheet separating effectiveness. Rather, in such a configuration, the air blower may lift the upper part of the stacked sheets as a bundle of sheets, possibly raising the risk of multiple feeding.

By contrast, the sheet separating device 100 of the present embodiment increases the sheet separating effectiveness even in a case in which the air outlet 124C is disposed below the end portion of the sheets (that is, in the direction of blowing up the upper part of the stacked sheets). That is, in the sheet separating device 100 of the present embodiment, the angle $\alpha$ of the front sheet floating restraint 130 allows the air to be blown to the end portion of the sheets at an appropriate angle.

Accordingly, the sheet separating device 100 more stably separates and feeds a plurality of sheets one by one than typical sheet separating devices.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

For example, the image forming apparatus incorporating the sheet separating device according to an embodiment described above is not limited to a monochrome image forming apparatus that forms monochrome toner images on recording media as illustrated in FIG. 7. Alternatively, the image forming apparatus may be a color image forming apparatus that forms color toner images on recording media. In addition, the image forming apparatus to which the embodiments of the present disclosure are applied includes but is not limited to a printer, a copier, a facsimile machine, or a multifunction peripheral having at least two capabilities of these devices.

What is claimed is:

1. A sheet separating device comprising:

a receptacle configured to hold a plurality of sheets;

a pickup rotator configured to feed the plurality of sheets one by one from the receptacle;

an air supplier including an air outlet disposed ahead of the receptacle in a sheet feeding direction in which the plurality of sheets is fed, the air supplier being configured to blow air out from the air outlet toward a leading end of the plurality of sheets, held on the receptacle, in the sheet feeding direction to separate the plurality of sheets from each other;

an upper guide plate disposed ahead of the receptacle in the sheet feeding direction; and a first sheet floating restraint on at least one side of the pickup rotator in a width direction of the sheet separating device perpendicular to the sheet feeding direction and extending above the plurality of sheets from the upper guide plate in a direction opposite the sheet feeding direction such that the first sheet floating restraint is adjustably secured via a screw to a long slot within the sheet separating device downstream of the receptacle to restrain floating of the plurality of sheets from the leading end thereof, the first sheet floating restraint including a proximal portion and a distal portion relatively further from the upper guide plate than the proximal portion, the proximal portion inclined at an acute angle, in a direction in which a distance between the first sheet floating restraint and a surface of the plurality of sheets increases from an air outlet side such that the acute angle is adjustable by raising or lowering the screw within the long slot, and the distal portion extending substantially perpendicular from the proximal portion in a direction away from the plurality of sheets in the receptacle.

2. The sheet separating device according to claim 1, further comprising:

a second sheet floating restraint on opposed widthwise end portions of the sheet separating device perpendicular to the sheet feeding direction to restrain the floating of the plurality of sheets separated from each other from side ends thereof.

3. The sheet separating device according to claim 2, further comprising:

an end fence configured to regulate a trailing end of the plurality of sheets in the sheet feeding direction, wherein the second sheet floating restraint is between the end fence and the first sheet floating restraint.

4. The sheet separating device according to claim 1, wherein the first sheet floating restraint is made of a material that guides air.

5. An image forming apparatus comprising:

the sheet separating device according to claim 1.

6. The sheet separating device of claim 1, wherein the first sheet floating restraint is on both sides of the pickup rotator in the width direction.

7. The sheet separating device of claim 1, wherein the first sheet floating restraint is directly above the air outlet ahead of the receptacle in the sheet feeding direction.

8. A sheet separating device comprising:

a receptacle configured to hold a plurality of sheets;

a pickup rotator configured to feed the plurality of sheets one by one from the receptacle;

an air supplier including an air outlet disposed near the receptacle, the air supplier being configured to blow air out from the air outlet toward an end surface of the plurality of sheets held on the receptacle to separate the plurality of sheets from each other;

an upper guide plate disposed ahead of the receptacle in a sheet feeding direction; and a first sheet floating restraint on at least one side of the pickup rotator in a width direction of the sheet separating device perpendicular to the sheet feeding direction and extending above the plurality of sheets from the upper guide plate in a direction opposite of the sheet feeding direction such that the first sheet floating restraint is adjustably secured via a screw to a long slot within the sheet separating device downstream of the receptacle to restrain floating of the plurality of sheets from a leading end thereof the first sheet floating restraint including a proximal portion and a distal portion relatively further from the upper guide plate than the proximal portion, the proximal portion being inclined, at an angle, in a direction in which a distance between the first sheet floating restraint and a surface of the plurality of sheets increases from an air outlet side such that the angle is adjustable by raising or lowering the screw within the long slot, and the distal portion extending substantially perpendicular from the proximal portion in a direction away from the plurality of sheets in the receptacle.

9. An image forming apparatus comprising:

the sheet separating device according to claim 8.

10. A sheet separating device comprising:

a receptacle configured to hold a plurality of sheets;

a pickup rotator configured to feed the plurality of sheets one by one from the receptacle;

an air supplier including an air outlet disposed ahead of the receptacle in a sheet feeding direction in which the plurality of sheets is fed, the air supplier being configured to blow air out from the air outlet toward a leading end of the plurality of sheets, held on the receptacle, in the sheet feeding direction to separate the plurality of sheets from each other;

an upper guide plate disposed ahead of the receptacle in the sheet feeding direction;

a first sheet floating restraint on at least one side of the pickup rotator in a width direction of the sheet separating device perpendicular to the sheet feeding direction and extending above the plurality of sheets from the upper guide plate such that the first sheet floating restraint is adjustably secured via a screw to a long slot within the sheet separating device to restrain floating of the plurality of sheets from the leading end thereof, the first sheet floating restraint including a proximal portion and a distal portion relatively further from the upper guide plate than the proximal portion, the proximal portion inclined at an acute angle, in a direction in which a distance between the first sheet floating restraint and a surface of the plurality of sheets increases from an air outlet side such that the acute angle is adjustable by raising or lowering the screw within the long slot, and the distal portion extending substantially perpendicular from the proximal portion in a direction away from the plurality of sheets in the receptacle;

a second sheet floating restraint on opposed widthwise end portions of the sheet separating device perpendicular to the sheet feeding direction to restrain the floating of the plurality of sheets separated from each other from side ends thereof; and an end fence configured to regulate a trailing end of the plurality of sheets in the sheet feeding direction, wherein the second sheet floating restraint is between the end fence and the first sheet floating restraint.

11. The sheet separating device according to claim 10, wherein the first sheet floating restraint is made of a material that guides air.

12. An image forming apparatus comprising the sheet separating device according to claim 10.

* * * * *